US007460802B2

(12) United States Patent
Nakamura et al.

(10) Patent No.: US 7,460,802 B2
(45) Date of Patent: Dec. 2, 2008

(54) DEVELOPING DEVICE, IMAGE FORMING APPARATUS HAVING THE SAME, AND IMAGE FORMING METHOD

(75) Inventors: Masahide Nakamura, Fulham Gardens (AU); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

(21) Appl. No.: 11/614,806

(22) Filed: Dec. 21, 2006

(65) Prior Publication Data

US 2007/0147862 A1 Jun. 28, 2007

(30) Foreign Application Priority Data

Dec. 22, 2005 (JP) ..... 2005-369794
Dec. 22, 2005 (JP) ..... 2005-369795

(51) Int. Cl.
*G03G 15/00* (2006.01)

(52) U.S. Cl. ..... 399/45

(58) Field of Classification Search ..... 399/45, 399/237, 249, 239, 240, 46, 57
See application file for complete search history.

(56) References Cited

U.S. PATENT DOCUMENTS 4,833,500 A * 5/1989 Mochizuki et al. ..... 399/55
6,141,517 A * 10/2000 Kuramochi et al. ..... 399/233
6,781,612 B1 * 8/2004 Detig ..... 347/112
6,853,827 B2 * 2/2005 Song et al. ..... 399/237
2006/0140678 A1 * 6/2006 Kim ..... 399/237

FOREIGN PATENT DOCUMENTS

JP 2002-278291 9/2002

* cited by examiner

*Primary Examiner*—Quana M Grainger
(74) *Attorney, Agent, or Firm*—Hogan & Hartson LLP

(57) ABSTRACT

The invention provides a developing device which can determine and set the suitable amount of toner on a development roller, the suitable voltage to be applied to a compaction roller, and the number of rotations of the compaction roller according to the type of paper, thereby providing a high quality image. The developing device of the invention comprises a development roller to which a liquid toner containing toner particles dispersed in carrier liquid is applied by a toner supplying roller. A developed image is formed on a photoreceptor by the development roller. The device comprises a compaction roller for compacting the toner particles in the liquid toner on the development roller at a position before the development on the photoreceptor. The device comprises a means of controlling the number of rotations of the toner supplying roller according to the type of paper and a means of controlling the voltage to be applied to the compaction roller according to the type of paper. The device further comprises a means of controlling the number of rotations of the compaction roller according to the type of paper. Alternatively, the device comprises a means of controlling the voltage to be applied to the toner supplying roller relative to the voltage to be applied to the development roller according to the type of paper and a means of controlling the voltage to be applied to the compaction roller.

10 Claims, 4 Drawing Sheets

A Some toner particles adhere to compaction roller

B Though no toner particles adhere to compaction roller, ribs are created

A Before compaction B Insufficient compaction C Suitable compaction D Excessive compaction A. State without ribs B. State with ribs

DEVELOPING DEVICE, IMAGE FORMING APPARATUS HAVING THE SAME, AND IMAGE FORMING METHOD

CROSS-REFERENCE TO RELATED APPLICATIONS

This application is based on Japanese Patent Applications No. 2005-369794 filed Dec. 22, 2005 and No. 2005-369795 filed Dec. 22, 2005, the entire contents including specifications, drawings, and abstracts of which are incorporated herein by reference.

BACKGROUND

1. Technical Field

The present invention relates to a developing device employing a liquid toner in which toner particles are dispersed in carrier liquid and relates to an image forming apparatus having the same and an image forming method.

As an example of such developing device wherein a latent image formed on a photoreceptor is developed by a development roller carrying a liquid developer, there has been proposed a developing device employing a liquid toner wherein the liquid toner on a development roller is compacted by a compaction roller before the development, independent voltages are applied to the development roller and the compaction roller, respectively such that the applied voltage of the compaction roller is higher than the applied voltage of the development roller so as to prevent fogging and density unevenness of images, thereby forming high quality images. In the developing device employing a liquid toner, a toner layer on the development roller is compacted into a film state so as to facilitate the movement of the toner layer in subsequent development and transfer processes, thereby forming an image without distortion and with high developing and transferring efficiency (see, for example, JP-A-2002-278291).

SUMMARY

Since toner particles in liquid toner has small diameter such as 0.1-2 μm, the amount of solid toner required for obtaining a predetermined density of image depends on the paper type (paper quality). In case of non-coated paper having low smoothness (specifically, recycled paper or cardboard having low density) or paper having rough surface such as so-called rough paper, it is required to use a larger amount of toner than that for printing on coated paper or paper having especially excellent smoothness among non-coated paper such as so-called cast paper or super art paper because an insufficient amount of toner can not enough coat fibers of such paper so as not to obtain the predetermined density. Accordingly, for achieving the predetermined density on paper having low smoothness or paper having rough surface, it is required to supply a larger mount of toner onto the development roller as compared to paper having excellent smoothness.

However, if the amount of toner on the development roller is increased, the toner can not be enough compacted into a secure film state (compaction state) under the same compaction condition. This is because the increase in thickness of the toner layer increases the gap between the development roller and the compaction roller so as to weaken the electrical field with the same voltage. In addition, since the amount of toner particles is increased, an electrical field which is stronger than normal is required for securely compacting all toner particles toward the development roller. Accordingly, if the toner is compacted under the same conditions, the movement of the toner particles to the development roller must be insufficient so that some toner particles adhere to the compaction roller, resulting in insufficient toner particles on the development roller. Since, at this point, there are toner particles on a separation interface at the exit of a nip portion between the compaction roller and the development roller as shown in FIG. 4-A, liquid containing toner particles threads, resulting in linear stains so-called "ribs" as shown in FIG. 6-B.

Even if the toner particles move to the development roller to the extent that they do not adhere to the compaction roller, there are also toner particles on the separation interface at the exit of the nip portion between the compaction roller and the development roller as shown in FIG. 4-B when the compaction of the toner particles to the development roller is insufficient, thus resulting in linear stains, i.e. ribs, as shown in FIG. 6-B.

Distortion in image due to ribs will now be described in further detail. The liquid should thread even when suitable compaction is conducted so that there are no particles on the interface. In this case, however, only the carrier liquid without toner particles threads so as to generate no stains. In addition, since the carrier liquid has a low degree of viscosity, a thread of the carrier liquid is fine. Since the carrier liquid is substantially Newtonian fluid and thus has a high fluidity, irregularities due to the threading flatten soon. That is, when suitable compaction is conducted, image distortion does not occur. However, the carrier liquid containing toner particles has a higher degree of viscosity than that of the carrier liquid without toner particles. Therefore, irregularities due to the threading are significant and are hardly flatten so that the irregularities are left as linear stains on an image.

The invention was made for solving the aforementioned problems. According to a first aspect of the invention, there is provided a developing device comprising: a development roller to which a liquid toner containing toner particles dispersed in carrier liquid is applied by a toner supplying roller; a photoreceptor on which a latent image to be developed by the development roller is formed; and a compaction roller for compacting the toner particles in the liquid toner on the development roller at a position before the development on the photoreceptor, and further comprising: a means of controlling the number of rotations of the toner supplying roller according to information of type of paper or a means of controlling the voltage to be applied to the toner supplying roller relative to the voltage to be applied to the development roller according to information of type of paper; and a means of controlling the voltage to be applied to the compaction roller according to the information of type of paper.

It is preferable that the developing device further comprises a means of controlling the number of rotations of the compaction roller according to the information of type of paper.

Further, it is preferable that the information of type of paper is judged according to the roughness or smoothness of the surface of paper.

According to another aspect of the invention, there is provided an image forming apparatus comprising: a development roller to which a liquid toner containing toner particles dispersed in carrier liquid is applied by a toner supplying roller; a photoreceptor on which a latent image to be developed by the development roller is formed; a compaction roller for compacting the toner particles in the liquid toner on the development roller at a position before the development on the photoreceptor; and an intermediate transfer member to which a toner image on the photoreceptor is transferred, and further comprising: a means of controlling the number of rotations of the toner supplying roller according to information of type of paper or a means of controlling the voltage to be applied to the toner supplying roller relative to the voltage to be applied to the development roller according to information of type of paper; and a means of controlling the voltage to be applied to the compaction roller according to the information of type of paper.

It is preferable that the image forming apparatus further comprises a means of controlling the number of rotations of the compaction roller according to the information of type of paper.

Further, it is preferable that the information of type of paper is judged according to the roughness or smoothness of the surface of paper.

Further, it is preferable that the image forming apparatus further comprises a paper type selecting means disposed on an apparatus main body, wherein one or more of the following parameters: the number of rotations of the toner supplying roller; the voltage to be applied to the toner supplying roller; the voltage to be applied to the compaction roller; and the number of rotations of the compaction roller, is controlled according to the information of the paper type selecting means.

According to another aspect of the invention, there is provided an image forming method of forming an image by using an image forming apparatus comprising: a development roller to which a liquid toner containing toner particles dispersed in carrier liquid is applied by a toner supplying roller; a photoreceptor on which a latent image to be developed by the development roller is formed; a compaction roller for compacting the toner particles in the liquid toner on the development roller at a position before the development on the photoreceptor; and an intermediate transfer member to which a toner image on the photoreceptor is transferred, the image forming method comprising: controlling the number of rotations of the toner supplying roller or the voltage to be applied to the toner supplying roller according to the information of type of paper; and controlling the voltage to be applied to the compaction roller according to the information of type of paper.

It is preferable that the number of rotations of the compaction roller is controlled according to information of type of paper.

Further, it is preferable that the apparatus main body has a paper type selecting means and wherein one or more of the following parameters: the number of rotations of the toner supplying roller; the voltage to be applied to the toner supplying roller; the voltage to be applied to the compaction roller; and the number of rotations of the compaction roller, is controlled according to the information of the paper type selecting means.

DESCRIPTION OF EXEMPLARY EMBODIMENTS

Figure 1:
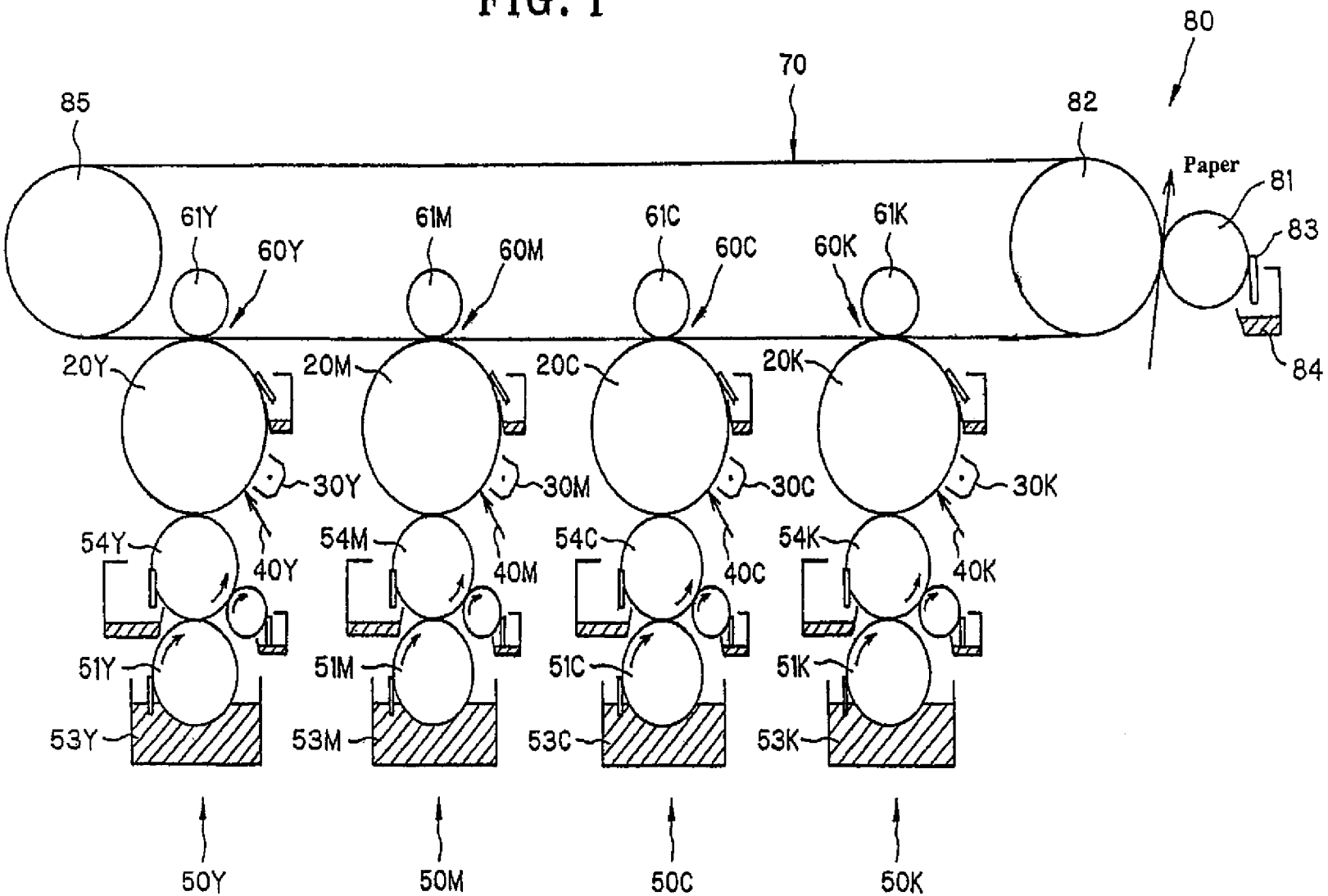
FIG. 1 is an illustration showing-main components of an image forming apparatus with developing devices according to an embodiment of the invention.

Hereinafter, embodiments of the invention will be described with referred to the attached drawings. FIG. 1 is an illustration showing main components of an image forming apparatus with developing devices according to an embodiment of the invention.

An intermediate transfer belt 70 is an endless belt and is laid to extend around and between a belt driving roller 82 and a driven roller 85 with some tension. The intermediate transfer belt 70 is driven to circle such that the intermediate transfer belt 70 is in contact with photoreceptors 20Y, 20M, 20C, 20K. By primary transfer units 60Y, 60M, 60C, 60K composed of primary transfer backup rollers 61Y, 61M, 61C, 61K and the photoreceptors 20Y, 20M, 20C, 20K, liquid toners of four colors are sequentially transferred to the intermediate transfer belt 70 and superposed on each other, thereby forming a full-color liquid toner image.

A secondary transfer unit 80 comprises a secondary transfer roller 81, the intermediate transfer belt driving roller 82, a secondary transfer roller blade 83, and a secondary transfer roller cleaning liquid collector 84. The secondary transfer unit 80 transfers a single color liquid toner image or a full-color liquid toner image formed on the intermediate transfer belt 70 to a recording medium such as paper.

A fixing unit (not shown) fuses the single color liquid toner image or the full-color liquid toner image transferred to the recording medium so that the single color liquid toner image or the full-color liquid toner image is fixed to the recording medium and thus becomes a permanent image.

Developing units 50Y, 50M, 50C, 50K have functions of developing latent images with yellow (Y) liquid toner, magenta (M) liquid toner, cyan (C) liquid toner, and black (K) liquid toner, respectively.

The developing units 50Y, 50M, 50C, 50K mainly comprise developing toner containers 53Y, 53M, 53C, 53K which store the liquid toners of respective colors, toner supplying rollers 51Y, 51M, 51C, 51K which supply the liquid toners of the respective colors from the developing toner containers to development rollers 54Y, 54M, 54C, 54K, chargers 30Y, 30M, 30C, 30K which charge the photoreceptors 20Y, 20M, 20C, 20K, and exposure units 40Y, 40M, 40C, 40K which form latent images on the charged photoreceptors.

Since the structures of the developing units 50Y, 50M, 50C, 50K are the same, the following description will be made as regard to the developing unit 50K.

As shown in FIG. 1, the charging unit 30K, the exposure unit 40K, and the primary transfer unit 60K are mainly arranged along the rotational direction of the photoreceptor 20K. The photoreceptor 20K has a cylindrical substrate and a photosensitive layer formed around the outer periphery thereof and is rotatable about its central axis. In this embodiment, the photoreceptor 20K rotates in the clockwise direction.

The charging unit 30K is a device for charging the photoreceptor 20K. The exposure unit 40K comprises a semiconductor laser, a polygon mirror, an F-θ lens, and the like and radiates modulated laser beam onto the charged photoreceptor 20K.

The developing unit 50K is a device for developing the latent image formed on the photoreceptor 20K with a black (K) liquid toner. The developing unit 50K will be described later again.

The primary transfer unit 60K is a device for transferring the black liquid toner image on the photoreceptor 20K to the intermediate transfer belt 70.

Figure 2:
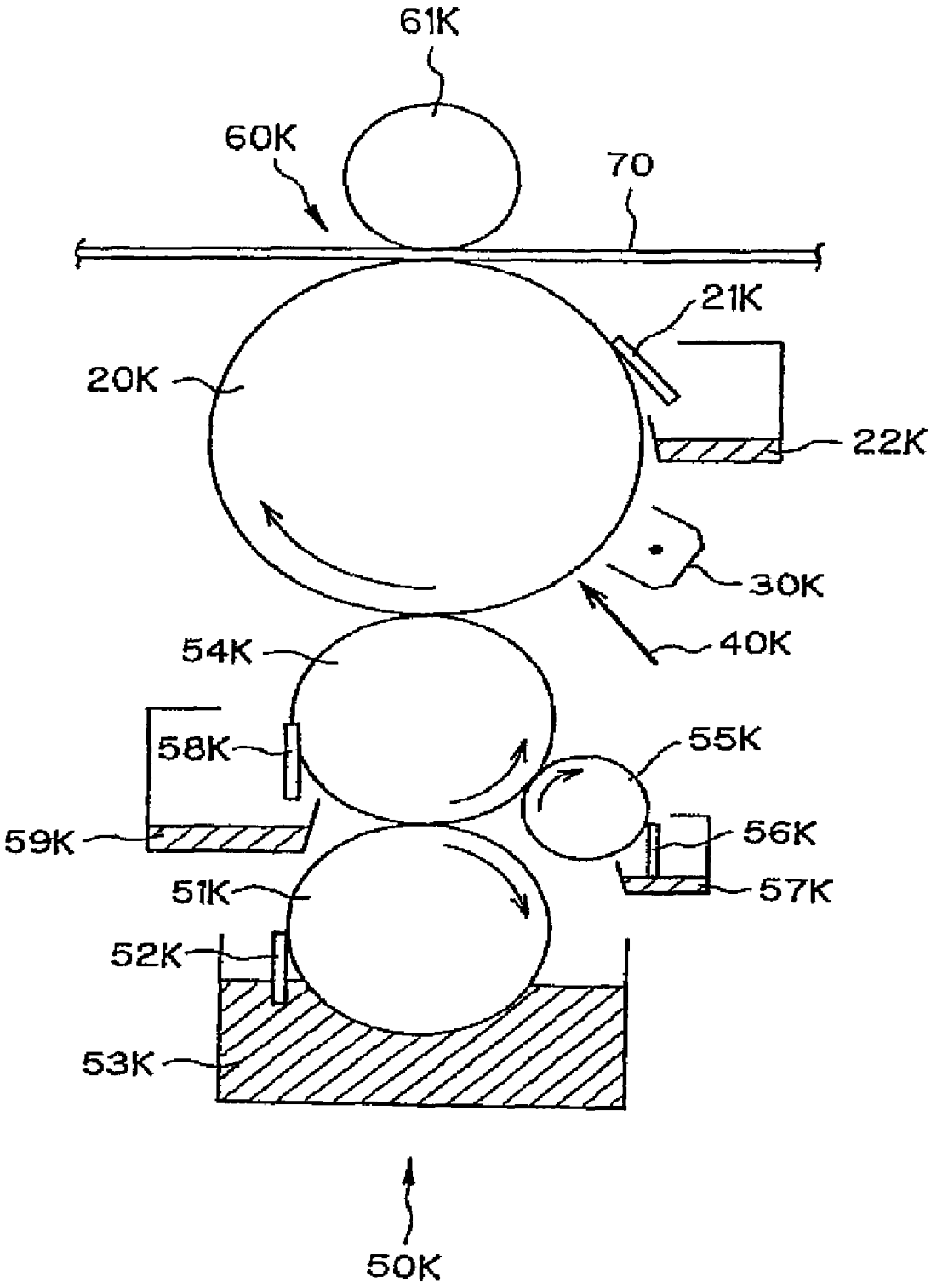
FIG. 2 is a sectional view showing main components of a black developing device.

FIG. 2 is a sectional view showing main components of the developing unit 50K. The developing toner container 53K stores the black liquid toner for developing the latent image formed on the photoreceptor 20K. The liquid toner employed in this embodiment is prepared by adding solid substance having mean particle diameter of 1 μm containing a colorant such as pigment dispersed in a thermoplastic resin to a liquid solvent such as an organic solvent, silicone oil, mineral oil, or cooking oil together with a dispersant. The liquid toner has nonvolatility at ambient temperatures; has concentration of toner solid substance about 25% and has a viscosity of from 30 to 10000 mPa·s.

The liquid toner is supplied from the developing toner container 53K to the development roller 54K by the toner supplying roller 51K. The toner supplying roller 51K is a cylindrical member and is rotatable in the clockwise direction as shown in FIG. 2. The toner supplying roller 51K is an anilox roller having fine concavities which are uniformly formed by a spiral groove in the surface thereof. As for the dimensions of the groove, the groove pitch is about 130 μm and the groove depth is about 30 μm.

A toner regulating blade 52K comprises a rubber portion made of urethane rubber or the like which is adapted to be in contact with the surface of the toner supplying roller 51K, and a plate made of metal or the like for supporting the rubber portion. The toner regulating blade 52K regulates the amount of liquid toner on the toner supplying roller 51K.

The development roller 54K is a cylindrical member and is adapted to rotate about its central axis in the counterclockwise direction as shown in FIG. 2. The development roller 54K comprises an inner core made of a metal such as iron and an elastic member such as conductive urethane rubber and a resin layer or a rubber layer which are formed on the outer periphery of the inner core. The development roller 54K is provided with a development roller blade 58K and a development roller cleaning liquid collector 59K. The development roller blade 58K is made of rubber or the like and is disposed to be in contact with the surface of the development roller 54K. The development roller bade 58K scrapes and removes liquid toner remaining on the development roller 54K. The development roller cleaning liquid collector 59K is a container for storing the liquid toner scraped by the development roller blade 58K.

The compaction roller 55K is a cylindrical member and is adapted to rotate about its central axis, and comprises a metal roller and a resin or rubber layer as the outer layer of the metal roller. The rotational direction of the compaction roller 55K is the clockwise direction opposite to the rotational direction of the development roller 54K as shown in FIG. 2. There is provided a potential difference between the compaction roller 55K and the development roller 54K by applying a voltage to the compaction roller 55K from a voltage applying member separate from that for the compaction roller 55K. A compaction roller blade 56K is made of rubber or the like and is disposed to be in contact with the surface of the compaction roller 56K. The compaction roller blade 56K scrapes and removes liquid toner remaining on the compaction roller 55K. A compaction roller cleaning liquid collector 57K is a container for storing the liquid toner scraped by the compaction roller blade 56K.

The photoreceptor 20K is a cylindrical member of which width is larger than the width of the development roller 54K and which has a photosensitive layer formed on the outer surface thereof, and is adapted to rotate about its central axis in the clockwise direction as shown in FIG. 2. The photosensitive layer of the photoreceptor 20K is composed of an organic photoreceptor or an amorphous silicon photoreceptor.

The charger 30K is disposed upstream of the nip portion between the photoreceptor 20K and the development roller 54K. The charger 30K is applied with a bias voltage having the same polarity as that of the liquid toner from a power source (not shown) so as to charge the photoreceptor 20K. The exposure unit 40K radiates laser beam to the charged photoreceptor 20K so as to form a latent image. The latent image thus formed is developed by the development roller 54K and is primarily transferred to the intermediate transfer belt 70 at the primary transfer unit 60K.

Hereinafter, the actions of the aforementioned developing devices and the image forming apparatus comprising the developing devices will be described. In like manner, description will be made as regard to the developing unit 50K as an example of the four developing units.

The liquid toner in the developing toner container 53K has concentration of toner solid substance about 25% and has a viscosity of from 30 to 10000 mPa·s. The charge of the toner particles is plus. The liquid toner is taken up from the developing toner container 53K by the rotation of the toner supplying roller 51K. The toner supplying roller 51K is rotated in a direction opposite to the direction of the development roller 54K at substantially the same surface speed as that of the development roller 54K. The toner supplying roller can be rotated at a peripheral speed higher than that of the development roller 54K in order to increase the amount of toner to be supplied to the development roller 54K according to the type of paper. The surface speed of the development roller 54K is 200 mm/s.

The toner regulating blade 52K is in contact with the surface of the toner supplying roller 51K to scrape excess liquid developer with leaving liquid developer within the groove formed in the surface of the toner supplying roller 51K, thereby regulating the amount of liquid toner to be supplied to the development roller 54K. By this regulation, the thickness of the liquid toner applied on the development roller 54K is quantified to be about 6 μm. The liquid toner scraped by the toner regulating blade 52K is dropped into the developing toner container 53K because of gravity.

The development roller 54K on which the liquid toner is applied comes in contact with the compaction roller 55K at downstream of the nip portion between the toner supplying roller 51K and the development roller 54K. A voltage about +300V is applied to the development roller 54K by a voltage applying member. Normally, the same voltage as that for the development roller 54K is applied to the toner supplying roller 51K. According to the type of paper, however, the voltage applied to the toner supplying roller 51K can be controlled to be higher than the voltage applied to the development roller 54K in order to increase the amount of toner to be applied to the development roller 54K. A voltage applied to the compaction roller 55K is higher than the voltage applied to the development roller 54K by 200-500V that depends on the type of paper. That is, when the voltage applied to the development roller 54K is +300V, the voltage applied to the compaction roller 55K varies depending on the type of paper within a range of from +500V to +800V.

Figure 3:
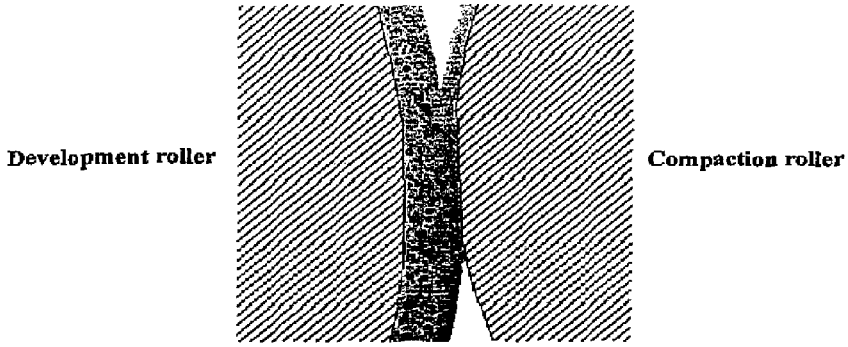
FIG. 3 is an illustration showing a state that liquid toner is compacted on a development roller by a compaction roller.
Figure 4:
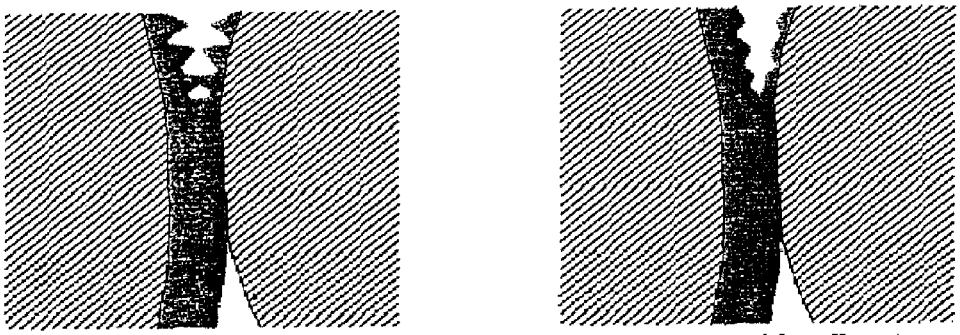
FIGS. 4-A and 4-B are illustrations showing states in which the compaction of liquid toner on the development roller by the compaction roller is insufficient.
Figure 5:
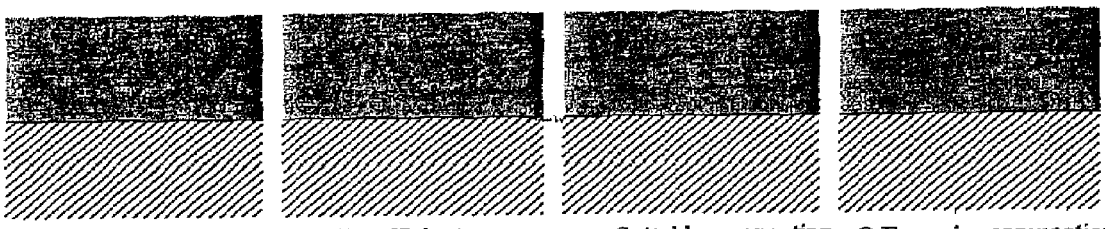
FIGS. 5-A through 5-D are illustrations showing the compaction states of liquid toner on the development roller.

Therefore, as shown in FIG. 3, toner particles on the development roller 54K move toward the development roller 54K during passing through the nip portion between the compaction roller 55K and the development roller 54K so that only the carrier liquid containing no or little toner particles is collected by the compaction roller 55K. Accordingly, the toner becomes to a suitable compaction state where toner particles are moderately connected into a film-like conformation as shown in FIG. 5-C. As a result, the transfer of the toner at the developing portion is facilitated so as to improve the image density.

The compaction roller 55K is rotated in a direction opposite to the direction of the development roller 54K at substantially the same surface speed as that of the development roller 54K. It should be noted that the compaction roller 55 can be controlled to have a speed difference relative to the rotational speed of the development roller 54K within a range of from 200 to 300 mm/s according to the type of paper.

The compaction roller brake 56K is disposed to be in contact with the compaction roller 55K. It should be noted that the compaction roller blade 56 is not necessarily provided. In this case, a carrier layer of a constant thickness is held on the compaction roller 55K and the amount of carrier in the toner layer on the development roller 54K does not change even after passing the nip portion between the compaction roller 55K and the development roller 55K.

The photoreceptor 20K uses amorphous silicon and applies a voltage about 5.5 kV to a wire of a corona charger 30K at an upstream of the nip portion between the development roller 54K and the photoreceptor 20K, thereby charging the surface of the photoreceptor 20K to be about +600V. After charging, a latent image is formed by the exposure unit 40K such that the imaging portion of the latent image has a potential of +25V. At the development nip portion formed between the development roller 54K and the photoreceptor 20K, the toner particles are selectively transferred to the imaging portion on the photoreceptor 20K according to an electric field generated by a bias voltage of +400V applied to the development roller 54K and the latent image (imaging portion +25V, non-imaging portion +600V) on the photoreceptor 20K, thereby forming a toner image on the photoreceptor 20K. Since the carrier liquid is not affected by the electric filed, the carrier liquid is separated at the exit of the development nip portion between the development roller 54K and the photoreceptor 20K so that the carrier liquid adheres to both the development roller 54K and the photoreceptor 20K.

After the development nip portion, the photoreceptor 20K passes the nip portion between the intermediate transfer belt 70 and the photoreceptor 20K, where the primary transfer is conducted. A voltage about −200V of a polarity opposite to the charging polarity of the toner particles is applied to the primary transfer backup roller 61K, whereby the toner particles on the photoreceptor 20K are primarily transferred to the intermediate transfer belt 70 so that only the carrier liquid remains on the photoreceptor 20K. The carrier liquid remaining on the photoreceptor 20K is scraped by the photoreceptor brake 21K at downstream of the primary transfer portion and is collected by the photoreceptor cleaning liquid collecting portion 22K.

The toner image transferred to the intermediate transfer belt 70 at the primary transfer unit 60K moves to the secondary transfer unit 80. At the secondary transfer unit 80, a voltage of −1000V is applied to the secondary transfer roller 81 and the voltage of the intermediate transfer belt driving roller 82 is kept 0V, whereby the toner particles on the intermediate transfer belt 70 is secondarily transferred to a recording medium such as a paper.

In the image forming process by the image forming apparatus with the aforementioned developing device, the amount of toner required for obtaining a predetermined density of image depends on the paper type. In case of non-coated paper having low smoothness (specifically, recycled paper or cardboard having low density) or paper having rough surface such as so-called rough paper, fibers of such paper can not be enough coated with the same amount of toner required for coated paper or even non-coated paper only in cases having especially excellent smoothness such as so-called cast paper or super art paper so that it is required to use a larger amount of toner to obtain the predetermined density. Accordingly, it is required to supply a larger amount of toner to the development roller as compared to such paper having excellent smoothness.

By the way, when the amount of toner (thickness of toner layer) on the development roller is increased, secure film state (compaction state) can not be achieved without any change in the compaction condition. This is because the increase in thickness of the toner layer increases the gap between the development roller and the compaction roller so as to weaken the electrical field with the same voltage. In addition, since the amount of toner particles is increased, an electrical field which is stronger than normal is required for securely compacting all toner particles toward the development roller.

In a first embodiment of the developing device of the invention, the following measurement is taken to solve the aforementioned problem. That is, for printing an image on a paper having rough surface such as so-called rough paper, the surface speed of the toner supplying roller 51K is controlled to be higher in order to increase the amount of toner to be applied to the development roller 54K. In addition, for compacting toner particles on the development roller 54K, the voltage to be applied to the compaction roller 55K is controlled to be higher. At the same time, the surface speed of the compaction roller 55K is controlled to be higher.

With regard to the first embodiment of the invention, tests as a reference state, Example 1, Example 2, and Comparative Examples 1 through 4 have been conducted and the results are shown below.

In the reference state where an image was printed on a coated paper or quality paper, the peripheral speed of the toner supplying roller 51K was 200 mm/s which was the same as that of the development roller 54K. In the reference state, the voltage to be applied to the compaction roller 55K was 550V which was higher than the voltage +300V to be applied to the development roller 54K by +250V. The peripheral speed of the compaction roller 55K was 200 mm/s which was the same as that of the development roller 54K. Under these conditions, an image was printed on a JCOAT paper available from Fuji Xerox Co., Ltd. (surface roughness Ra=1.0 μm). As a result, the density (average of 10 points) of the solid portion on the paper was 1.36.

As Example 1, a recycled paper (Steinbeis paper available from Fuji Xerox Co., Ltd.; surface roughness Ra=3.8 μm) was used. In this example, the peripheral speed of the toner supplying roller 51K was increased to 260 mm/s, the voltage to be applied to the compaction roller 55K was increased to 650V, and the peripheral speed of the compaction roller 55K was 200 mm/s which was the same as the peripheral speed of the development roller 54K. Under these conditions, an image was printed. As a result, the density on the paper was 1.33.

As Example 2, a rough paper (Neenah Bond paper available from Neenah Paper Inc.; Ra=5.2 μm) was used. In this example, the peripheral speed of the toner supplying roller 51K was 330 mm/s, the voltage to be applied to the compaction roller 55K was 700V, and the peripheral speed of the compaction roller 55K was 280 mm/s. Under these conditions, an image was printed. As a result, the density on the paper was 1.35.

As Comparative Example 1, a recycled paper which was the same one as used in Example 1 was used. Under the same conditions as those of the reference state, an image was printed. As a result, the density on the paper was deteriorated to be 1.1 8. As the state of the paper was observed at this point, the amount of toner was insufficient so that some fibers of the paper were not coated with toner so as to expose white portions.

feeding direction were found and portion not coated with toner were found similar to Comparative Example 3.

The measurement of density on paper was conducted by using a densitometer SpectroEye available from GretagMacbeth according to the density standard ANSI-A with a luminous source of D50 and an observing angle of 2 degrees. Densities at 10 points of the solid portion were measured and an average was calculated. Results of the measurements are shown in Table 1.

TABLE 1

| | Paper type | Peripheral speed (mm/s) of supplying roller | Voltage (V) applied to compaction roller | Peripheral speed (mm/s) of compaction roller | Density on paper |
|---|---|---|---|---|---|
| Reference | Quality paper (JCOAT paper available from Fuji Xerox Co., Ltd.; Ra = 1.0 μm) | 200 | 550 | 200 | 1.36 |
| Example 1 | Recycled paper (Steinbein paper available from Fuji Xerox, Co., Ltd.; Ra = 3.8 μm) | 260 | 650 | 200 | 1.33 |
| Example 2 | Rough paper (Neenah Bond paper available from Neenah Paper Inc.; Ra = 5.2 μm) | 330 | 700 | 280 | 1.35 |
| Comparative Example 1 | Recycled paper the same as used in Example 1 | 200 | 550 | 200 | 1.18 |
| Comparative Example 2 | Rough paper the same as used in Example 2 | 200 | 550 | 200 | 1.05 |
| Comparative Example 3 | Recycled paper the same as used in Example 1 | 260 | 550 | 200 | 1.11 |
| Comparative Example 4 | Rough paper the same as used in Example 2 | 330 | 550 | 200 | 1.02 |

As Comparative Example 2, a rough paper which was the same one as used in Example 2 was used. Under the same conditions as those of the reference state, an image was printed. As a result, the density on the paper was deteriorated to be 1.05. As the state of the paper was observed at this point, some fibers of the paper were not coated with toner so as to expose white portions similar to Comparative Example 1. The white portions were discovered sooner than the white portions of Comparative Example 1.

Figure 6:
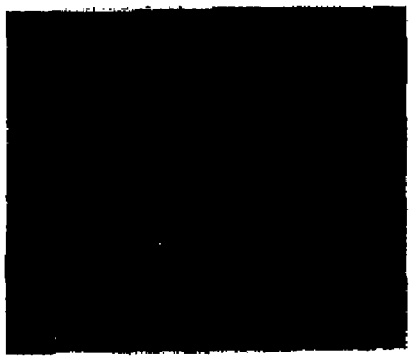
FIGS. 6-A and 6-B are illustrations showing a state without ribs and a state with ribs.
Figure 6:
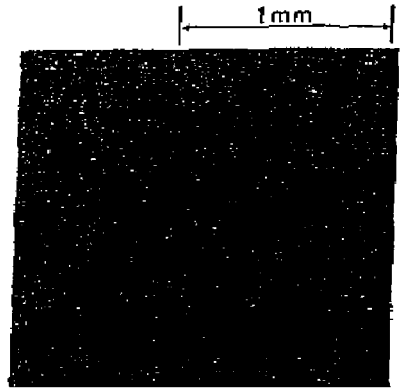

As Comparative Example 3, a recycled paper which was the same one as used in Example 1 was used, the peripheral speed of the supplying roller 51K was set to 260 mm/s, and the conditions of the compaction roller 55K remained the same as the reference state. Under these conditions, an image was printed. In this case, the density on the paper was just 1.11. As the state of the paper was observed, linear stains in the paper feeding direction as shown in FIG. 6-B were found. The density at the linear stains due to the unevenness in density was deteriorated as compared to the portion without linear stains. The reason of the linear stains was occurrence of ribs at the exit of the nip portion between the development roller 54K and the compaction roller 55K because the toner layer on the development roller 54K was insufficiently compacted. Due to the insufficient compaction, toner particles were insufficiently transferred to the photoreceptor in the development process so that some toner particles remained on the development roller 54K.

As Comparative Example 4, a rough paper which is the same one as used in Example 2 was used, the peripheral speed of the supplying roller 51K was set to 330 mm/s, and the conditions of the compaction roller 55K remained the same as the reference state. Under these conditions, an image was printed. In this case, the density on the paper was just 1.02. As the state of the paper was observed, linear stains in the paper As a method of selecting the type of paper, the image forming apparatus is provided with a plurality of paper type modes, besides a standard mode, corresponding to a plurality of types of paper such that each mode has a rotation speed of the supplying roller, a voltage to be applied to the compaction roller, and a rotation speed of the compaction roller which are set for the corresponding type of paper. User can select one from the plurality of paper type modes to correspond to the type of paper.

In a second embodiment of the developing device of the invention, the following measurement is taken. That is, for printing an image on a paper having rough surface such as so-called rough paper, the voltage to be applied to the toner supplying roller 51K is controlled to be higher in order to increase the amount of toner to be applied to the development roller 54K. In addition, for compacting toner particles on the development roller 54K, the voltage to be applied to the compaction roller 55K is controlled to be higher. At the same time, the surface speed of the compaction roller 55K is controlled to be the same as or lower than normal.

With regard to the second embodiment of the invention, tests as a reference state, Example 3, Example 4, and Comparative Examples 5 through 8 have been conducted and the results are shown below.

In the reference state where an image was printed on a coated paper or quality paper, the voltage to be applied to the toner supplying roller 51K was set to 300V, i.e. the same as the voltage to be applied to the development roller 54K. In the reference state, the voltage to be applied to the compaction roller 55K was 550V which was higher than the voltage +300V to be applied to the development roller 54K by +250V. The peripheral speed of the compaction roller 55K was 200 mm/s which was the same as that of the development roller 54K. Under these conditions, an image was printed on a JCOAT paper available from Fuji Xerox Co., Ltd. (surface roughness Ra=1.0 μm). As a result, the density (average of 10 points) of the solid portion on the paper was 1.36.

As Example 3, a recycled paper (Steinbeis paper available from Fuji Xerox Co., Ltd.; surface roughness Ra=3.8 μm) was used. In this example, the voltage to be applied to the toner supplying roller 51K was increased to 500V, the voltage to be applied to the compaction roller was increased to 630V, and the peripheral speed of the compaction roller 55K was 200 mm/s which was the same as the peripheral speed of the development roller 54K. Under these conditions, an image was printed. As a result, the density on the paper was 1.38.

As Example 4, a rough paper (Neenah Bond paper available from Neenah Paper Inc.; Ra=5.2 μm) was used. In this example, the voltage to be applied to the toner supplying roller 51K was increased to 600V, the voltage to be applied to the compaction roller 55K was 690V, and the peripheral speed of the compaction roller 55K was decreased to 140 mm/s. Under these conditions, an image as printed. As a result the density on the paper was 1.32.

As Comparative Example 5, a recycled paper which was the same one as used in Example 3 was used. Under the same conditions as those of the reference state, an image was printed. As a result, the density on the paper was deteriorated to be 1.18. As the state of the paper was observed at this point, the amount of toner was insufficient so that some fibers of the paper were not coated with toner so as to expose white portions.

The density at the linear stains due to the unevenness in density was deteriorated as compared to the portion without linear stains. The reason of the linear stains was occurrence of ribs at the exit of the nip portion between the development roller 54K and the compaction roller 55K because the toner layer on the development roller 54K was insufficiently compacted. Due to the insufficient compaction, toner particles were insufficiently transferred to the photoreceptor in the development process so that some toner particles remained on the development roller 54K.

As Comparative Example 8, a rough paper which is the same one as used in Example 4 was used, the voltage to be applied to the supplying roller 51K was increased to 600V, and the conditions of the compaction roller 55K remained the same as the reference state. Under these conditions, an image was printed. In this case, the density on the paper was just 1.09. As the state of the paper was observed, linear stains in the paper feeding direction were found and portion not coated with toner were found similar to Comparative Example 7.

The measurement of density on paper was conducted by using a densitometer SpectroEye available from GretagMacbeth according to the density standard ANSI-A with a luminous source of D50 and an observing angle of 2 degrees. Densities at 10 points of the solid portion were measured and an average was calculated. Results of the measurements are shown in Table 1.

TABLE 2

| | Paper type | Voltage (V) applied to supplying roller | Voltage (V) applied to to compaction roller | Peripheral speed (mm/s) of compaction roller | Density on paper |
|---|---|---|---|---|---|
| Reference | Quality paper (JCOAT paper available from Fuji Xerox Co., Ltd.; Ra = 1.0 μm) | 300 | 550 | 200 | 1.36 |
| Example 3 | Recycled paper (Steinbein paper available from Fuji Xerox Co., Ltd.; Ra = 3.8 μm) | 500 | 630 | 200 | 1.38 |
| Example 4 | Rough paper (Neenah Bond paper available from Neenah Paper Inc.; Ra = 5.2 μm) | 600 | 690 | 140 | 1.32 |
| Comparative Example 5 | Recycled paper the same as used in Example 3 | 300 | 550 | 200 | 1.18 |
| Comparative Example 6 | Recycled paper the same as used in Example 4 | 300 | 550 | 200 | 1.05 |
| Comparative Example 7 | Recycled paper the same as used in Example 3 | 500 | 550 | 200 | 1.17 |
| Comparative Example 8 | Rough paper the same as used in Example 4 | 600 | 550 | 200 | 1.09 |

As Comparative Example 6, a rough paper which was the same one as used in Example 4 was used. Under the same conditions as those of the reference state, an image was printed. As a result, the density on the paper was deteriorated to be 1.05. As the state of the paper was observed at his point, some fibers of the paper were not coated with toner so as to expose white portions similar to Comparative Example 5. The white portions were discovered sooner than the white portions of Comparative Example 5.

As Comparative Example 7, a recycled paper which was the same one as used in Example 3 was used, the voltage to be applied to the supplying roller 51K was increased to 500V, and the conditions of the compaction roller 55K remained the same as the reference state. Under these conditions, an image was printed. In this case, the density on the paper was just 1.17. As the state of the paper was observed, linear stains in the paper feeding direction as shown in FIG. 6-B were found.

As a method of selecting the type of paper, the image forming apparatus is provided with a plurality of paper type modes, besides a standard mode, corresponding to a plurality of types of paper such that each mode has a voltage to be applied to the supplying roller 51K, a voltage to be applied to the compaction roller, and a rotation speed of the compaction roller which are set for the corresponding type of paper. User can select one from the plurality of paper type modes to correspond to the type of paper.

What is claimed is:

1. A developing device comprising: a development roller to which a liquid toner containing toner particles dispersed in carrier liquid is applied by a toner supplying roller; a photoreceptor on which a latent image to be developed by the development roller is formed; and a compaction roller for compacting the toner particles in the liquid toner on the development roller at a position before the development on the photoreceptor; and further comprising: a paper type selecting means for acquiring information of a type of paper; a means of controlling the number of rotations of the toner supplying roller according to the information of the type of paper or a means of controlling the voltage to be applied to the toner supplying roller relative to the voltage to be applied to the development roller according to the information of the type of paper; and a means of controlling the voltage to be applied to the compaction roller according to the information of the type of paper.

2. A developing device as claimed in claim 1, further comprising a means of controlling the number of rotations of the compaction roller according to the information of the type of paper.

3. A developing device as claimed in claim 1 or 2, wherein the information of the type of paper is judged according to the roughness or smoothness of the surface of the paper.

4. An image forming apparatus comprising: a development roller to which a liquid toner containing toner particles dispersed in carrier liquid is applied by a toner supplying roller; a photoreceptor on which a latent image to be developed by the development roller is formed; a compaction roller for compacting the toner particles in the liquid toner on the development roller at a position before the development on the photoreceptor; and an intermediate transfer member to which a toner image on the photoreceptor is transferred, and further comprising: a paper type selecting means for acquiring information of a type of paper; a means of controlling the number of rotations of the toner supplying roller according to the information of the type of paper or a means of controlling the voltage to be applied to the toner supplying roller relative to the voltage to be applied to the development roller according to the information of the type of paper; and a means of controlling the voltage to be applied to the compaction roller according to the information of the type of paper.

5. An image forming apparatus as claimed in claim 4, further comprising a means of controlling the number of rotations of the compaction roller according to the information of the type of paper.

6. An image forming apparatus as claimed in claim 4, wherein the information of the type of paper is judged according to the roughness or smoothness of the surface of the paper.

7. An image forming apparatus as claimed in any one of claims 4 through 6, wherein one or more of the following parameters: the number of rotations of the toner supplying roller; the voltage to be applied to the toner supplying roller; the voltage to be applied to the compaction roller; and the number of rotations of the compaction roller, is controlled according to the information of the paper type selecting means.

8. An image forming method of forming an image by using an image forming apparatus comprising: a development roller to which a liquid toner containing toner particles dispersed in carrier liquid is applied by a toner supplying roller; a photoreceptor on which a latent image to be developed by the development roller is formed; a compaction roller for compacting the toner particles in the liquid toner on the development roller at a position before the development on the photoreceptor; an intermediate transfer member to which a toner image on the photoreceptor is transferred; and a paper type selecting means for acquiring information of a type of paper, the image forming method comprising:

acquiring the information of the type of paper with the paper type selecting means;

controlling the number of rotations of the toner supplying roller or the voltage to be applied to the toner supplying roller according to the information of the type of paper; and controlling the voltage to be applied to the compaction roller according to the information of the type of paper.

9. An image forming method as claimed in claim 8, wherein the number of rotations of the compaction roller is controlled according to the information of the type of paper.

10. An image forming method as claimed in claim 8 or 9, wherein one or more of the following parameters: the number of rotations of the toner supplying roller; the voltage to be applied to the toner supplying roller; the voltage to be applied to the compaction roller; and the number of rotations of the compaction roller, is controlled according to the information of the paper type selecting means.

* * * * *